US010244836B2

(12) United States Patent
Liu

(10) Patent No.: US 10,244,836 B2
(45) Date of Patent: Apr. 2, 2019

(54) AUTOMATIC INVERSELY FOLDABLE UMBRELLA

(71) Applicant: Hao-Ming Liu, Taichung (TW)

(72) Inventor: Hao-Ming Liu, Taichung (TW)

( * ) Notice: Subject to any disclaimer, the term of this patent is extended or adjusted under 35 U.S.C. 154(b) by 59 days.

(21) Appl. No.: 15/582,028

(22) Filed: Apr. 28, 2017

(65) Prior Publication Data

US 2018/0084878 A1 Mar. 29, 2018

(30) Foreign Application Priority Data

Mar. 1, 2016 (TW) ..... 105202809 U

(51) Int. Cl.

| | |
|---|---|
| ***A45B 19/10*** | (2006.01) |
| ***A45B 25/02*** | (2006.01) |
| ***A45B 25/18*** | (2006.01) |
| ***A45B 19/00*** | (2006.01) |
| ***A45B 25/14*** | (2006.01) |
| *A45B 25/06* | (2006.01) |

(52) U.S. Cl.

CPC ..... *A45B 19/10* (2013.01); *A45B 25/02* (2013.01); *A45B 25/18* (2013.01); *A45B 25/06* (2013.01); *A45B 25/143* (2013.01); *A45B 2019/008* (2013.01); *A45B 2025/186* (2013.01)

(58) Field of Classification Search

CPC ..... A45B 2019/008; A45B 2019/001; A45B 25/02; A45B 25/186

See application file for complete search history.

(56) References Cited

U.S. PATENT DOCUMENTS

| | | | | |
|---|---|---|---|---|
| 5,020,558 | A * | 6/1991 | Huang | A45B 25/16 135/24 |
| 7,913,709 | B2 * | 3/2011 | Brebner | A45B 19/06 135/31 |
| 9,486,044 | B1 * | 11/2016 | Dai | A45B 25/22 |
| 9,549,595 | B1 | 1/2017 | Liu | |
| 9,629,426 | B1 * | 4/2017 | Dai | A45B 19/10 |
| 2004/0211451 | A1 * | 10/2004 | Goh | A45B 25/20 135/31 |
| 2017/0156460 | A1 * | 6/2017 | Liu | A45B 25/22 |
| 2018/0295955 | A1 * | 10/2018 | Dai | A45B 19/12 |

FOREIGN PATENT DOCUMENTS

| | | |
|---|---|---|
| TW | M514236 U | 12/2015 |
| TW | M516864 U | 2/2016 |

* cited by examiner

*Primary Examiner* — David R Dunn
*Assistant Examiner* — Danielle Jackson
(74) *Attorney, Agent, or Firm* — Muncy, Geissler, Olds & Lowe, P.C.

(57) ABSTRACT

An automatic inversely foldable umbrella includes a skeleton structure provided with a main shaft; an upper runner fixed to one end of the main shaft; a lower runner slidably disposed on the main shaft; a middle runner slidably disposed on the main shaft between the upper runner and the lower runner; plural skeleton linkages having a first rib, a second rib, and a foldable rib; plural linking members with one end pivotally disposed on the lower runner and the other end connected with the first rib; a resilient member disposed between the middle runner and the lower runner, and compressible due to the middle runner and the lower runner movement; a first canopy combined to the upper runner and a second canopy combined to the lower runner for covering the skeleton linkages; and a handle. Therefore, the folding and expanding operation of the umbrella are facilitated.

12 Claims, 6 Drawing Sheets

AUTOMATIC INVERSELY FOLDABLE UMBRELLA

BACKGROUND OF THE INVENTION

1. Field of the Invention

The present invention relates to umbrellas capable of being folded or adjusted in a specific way, and more particularly, to an automatic inversely foldable umbrella stably operated when being folded or expanded.

2. Description of the Related Art

A conventional umbrella includes a shaft, a handle, and a canopy. The handle is disposed on one end of the shaft. When the umbrella is folded, the canopy contracts toward the handle. However, the conventional umbrella requires a relatively large space during the folding or expanding process. When the user needs to expand or fold the umbrella during a rainy day for getting into out getting out a vehicle, the door of the vehicle shall be opened to a large scope. As a result, the user usually gets his/her body wet.

For improving the inconvenience of the conventional umbrella, TW patent M514236 discloses an inversely foldable umbrella including a main shaft, a covering canopy, and a lining canopy. The main shaft is provided with opposite two ends, wherein one end is provided with a handle portion. When the inversely foldable umbrella is folded, the covering canopy and the lining canopy contract toward one end of the main shaft away from the handle portion. Therefore, the door of the vehicle is only needed to be slightly opened, such that the inversely foldable umbrella is able to be folded or expanded outside the vehicle. However, such inversely foldable umbrella does not achieve an automatic expanding function. As a result, the user needs to apply both of his/her hands for operating the umbrella. The solution for such issue is desired.

SUMMARY OF THE INVENTION

For improving the issues above, an automatic inversely foldable umbrella is disclosed. When the user in the vehicle needs to operate the umbrella, the vehicle door is only opened in a minimum degree, and the umbrella automatically expands, preventing the user from getting his/her body wet.

An embodiment of the present invention provides an automatic inversely foldable umbrella, comprising:

a skeleton structure, wherein the skeleton structure further comprises:

a main shaft;

an upper runner fixed to one end of the main shaft;

a lower runner slidably disposed on the main shaft;

a middle runner slidably disposed on the main shaft between the upper runner and the lower runner, the middle runner including a first connecting end facing the upper runner and a second connecting end facing the lower runner;

plural skeleton linkages, each skeleton linkage including a first rib, a second rib, and a foldable rib, one end of the first rib pivotally disposed on the second connecting end of the middle runner, one end of the foldable rib pivotally disposed on the upper runner with the other end of the foldable rib pivotally connected to an end of the first rib away from the middle runner, one end of the second rib pivotally disposed on the first connecting end of the middle runner with the other end of the second rib pivotally disposed on the foldable rib;

plural linking members, one end of each linking member pivotally disposed on the lower runner with the other end of the linking member connected with the first rib;

a resilient member disposed between the middle runner and the lower runner, the resilient member compressed due to a movement of the middle runner and the lower runner;

a first canopy combined to the upper runner;

a second canopy combined to the lower runner, the first canopy and the second canopy covering the skeleton linkages; and a handle combined to the main shaft and disposed away from the upper runner, the handle including a control structure optionally engaging the lower runner.

In an embodiment, the linking member is flexible.

In an embodiment, the linking member is covered by the second canopy. Also, the length of the linking member is smaller than the length of the second rib, and the length of the second rib is smaller than the length of the first rib.

In an embodiment, the second canopy is provided with plural combing portions that are tied on the first rib.

In an embodiment, the first canopy is provided with plural combining portions that are tied on the foldable rib.

In an embodiment, the resilient member refers to a compressible spring.

In an embodiment, the control structure is housed inside the handle and provided with a control button which is resiliently operated.

In an embodiment, the first rib is provided with a positioning portion having an open positioning notch for engaging the corresponding linking member.

In an embodiment, the foldable rib is provided with a first disposition portion and a second disposition portion. The first disposition portion is disposed in adjacent to the joint where the first canopy contacts the second canopy. The second disposition portion is disposed between the first disposition portion and the upper runner. The first disposition portion is pivotally connected by the first rib, and the second disposition portion is pivotally connected by the second rib.

In an embodiment, plural pulling members are further comprised, wherein each pulling member is disposed between the foldable rib and corresponding the first rib.

In an embodiment, one end of the pulling member and the second rib are pivotally connected with the second disposition portion, wherein the other end of the pulling member winds the first rib.

In an embodiment, the length of the pulling member is larger than the length of the linking member.

In an embodiment, the foldable rib includes a first foldable rod, a second foldable rod, and a folding portion between the first and second foldable rods, such that the first foldable rod is allowed to be folded toward the upper runner.

In an embodiment, the folding portion is positioned between the first disposition portion and the second disposition portion, and the distance between the folding portion and the second disposition portion is smaller than the distance between the folding portion and the first disposition portion.

In an embodiment, when the control structure engages the lower runner, the skeleton linkage is performed in a folded status. When the control structure disengages the lower runner, the skeleton linkage is performed in an expanded status, and the first rib, the linking member, and the foldable rib are performed in a bent shape.

With such configuration, an end of the linking member is engaged in the positioning notch of the first rib, providing an easy assembling and maintaining function. The folding and expanding operation of the umbrella is stabilized; also, the assembling and disassembling process between the skeletons of the skeleton linkages and the linking members are simplified.

The control structure is disposed in the handle, improving the simplicity of the appearance, lowering the risk of malfunction, and enhancing the safety of usage.

The automatic inversely foldable umbrella provided by the present invention, in the operation, is automatically expanded by use of the resilient force of the resilient member returning to the normal length. The user is able to operate the umbrella by using one hand pressing the control button. Therefore, the umbrella is favorable for the user in a vehicle, such that the vehicle door needs only to be opened in a minimum scope, preventing the user from getting him/herself wet.

The linking members in the present invention are combined to the corresponding first rib and disposed in adjacent of the pivoting end of the first rib, respectively. Therefore, when folding the umbrella, the user is able to save the strength needed; when expanding the umbrella, the user is able to have the umbrella be automatically expanded by use of the resilient force of the resilient member.

DETAILED DESCRIPTION OF THE INVENTION

The aforementioned and further advantages and features of the present invention will be understood by reference to the description of the preferred embodiment in conjunction with the accompanying drawings where the components are illustrated based on a proportion for explanation but not subject to the actual component proportion. Embodiments of the present invention are illustrated in detail along with the drawings. However, the technical features included by the present invention are not limited to certain embodiments hereby provided. Scope of the present invention shall be referred to the claims, which include all the possible replacements, modifications, and equivalent features.

Referring to FIG. 1 to FIG. 6, the automatic inversely foldable umbrella comprises a skeleton structure 1, a handle 2, a first canopy 3, and a second canopy 4. The handle 2, the first canopy 3, and the second canopy 4 are combined to the skeleton structure 1.

Figure 1:
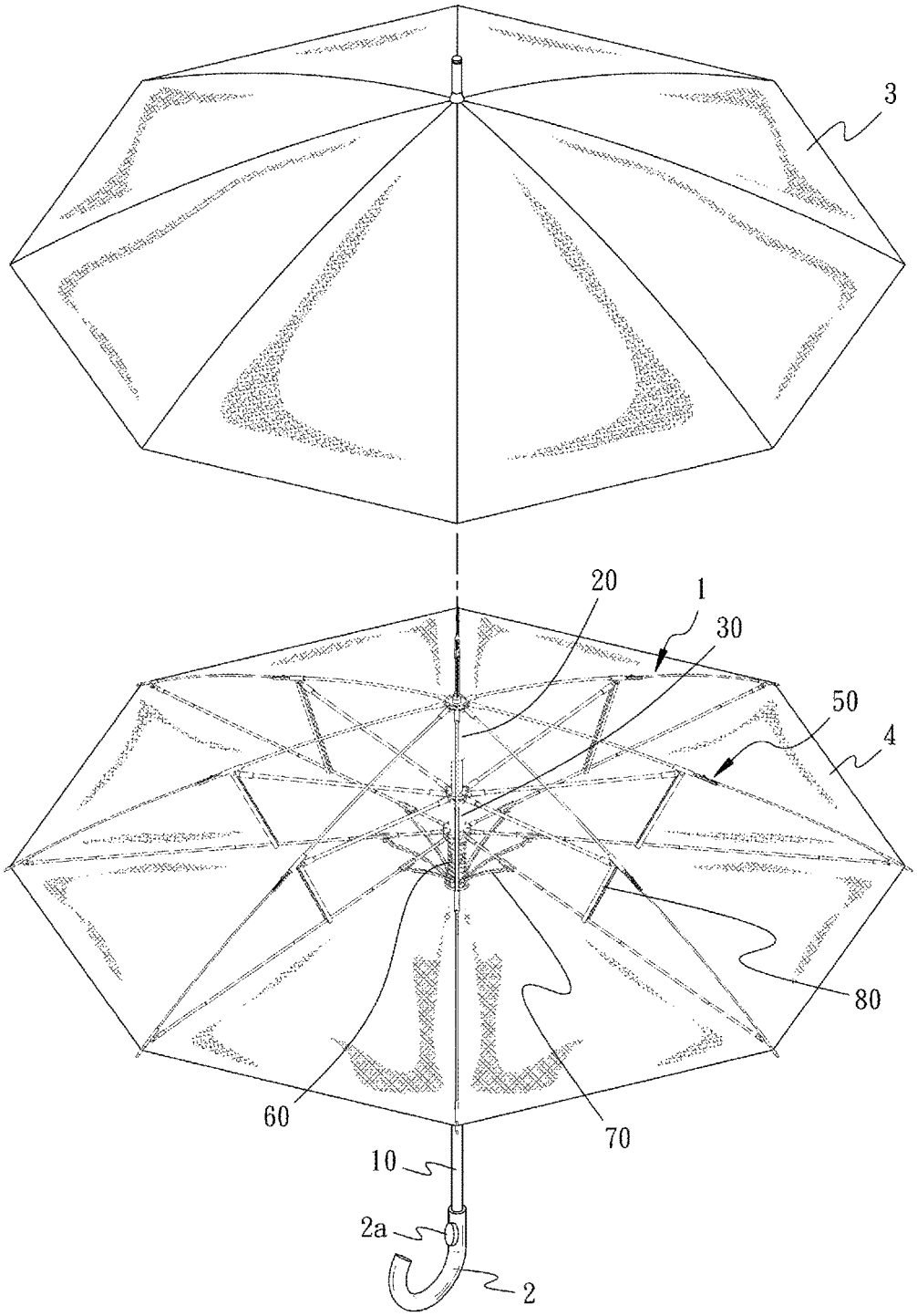
FIG. 1 is a partial exploded view of the automatic inversely foldable umbrella in accordance with an embodiment of the present invention.
Figure 2:
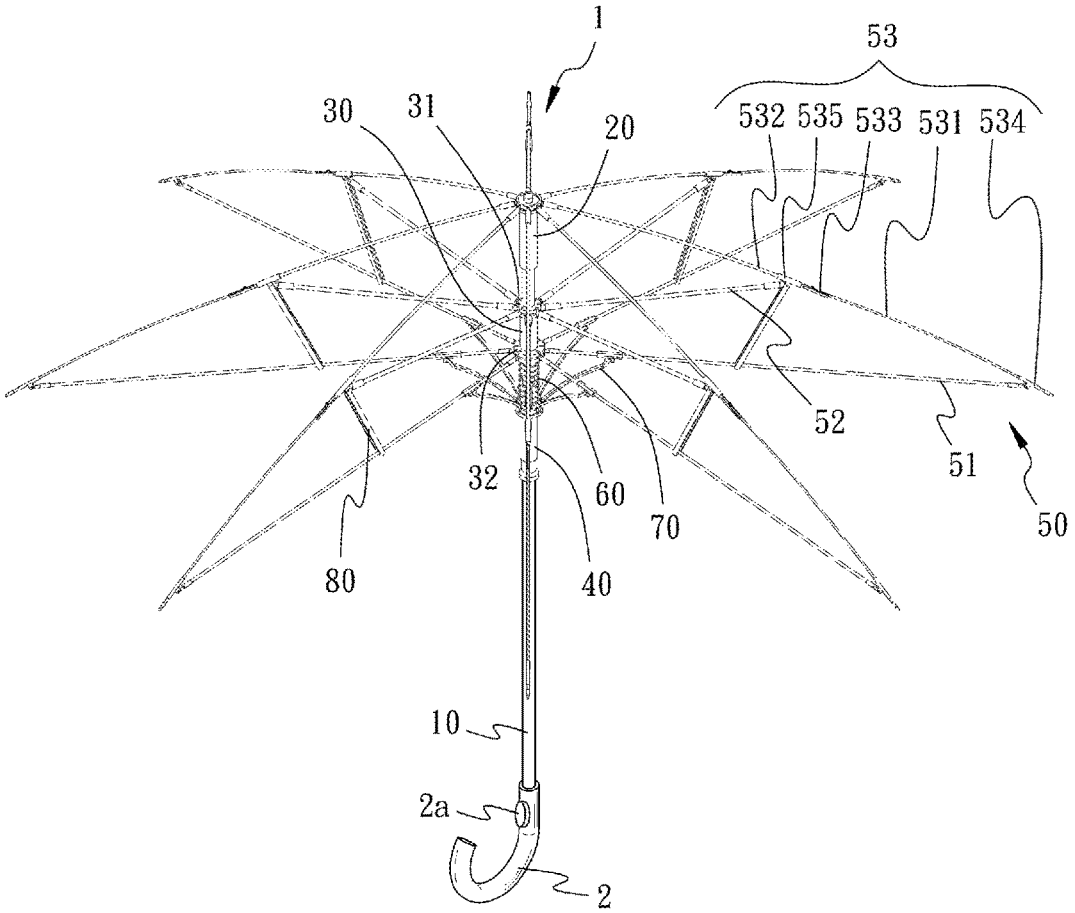
FIG. 2 is a perspective view of the skeleton structure of the automatic inversely foldable umbrella.
Figure 3:
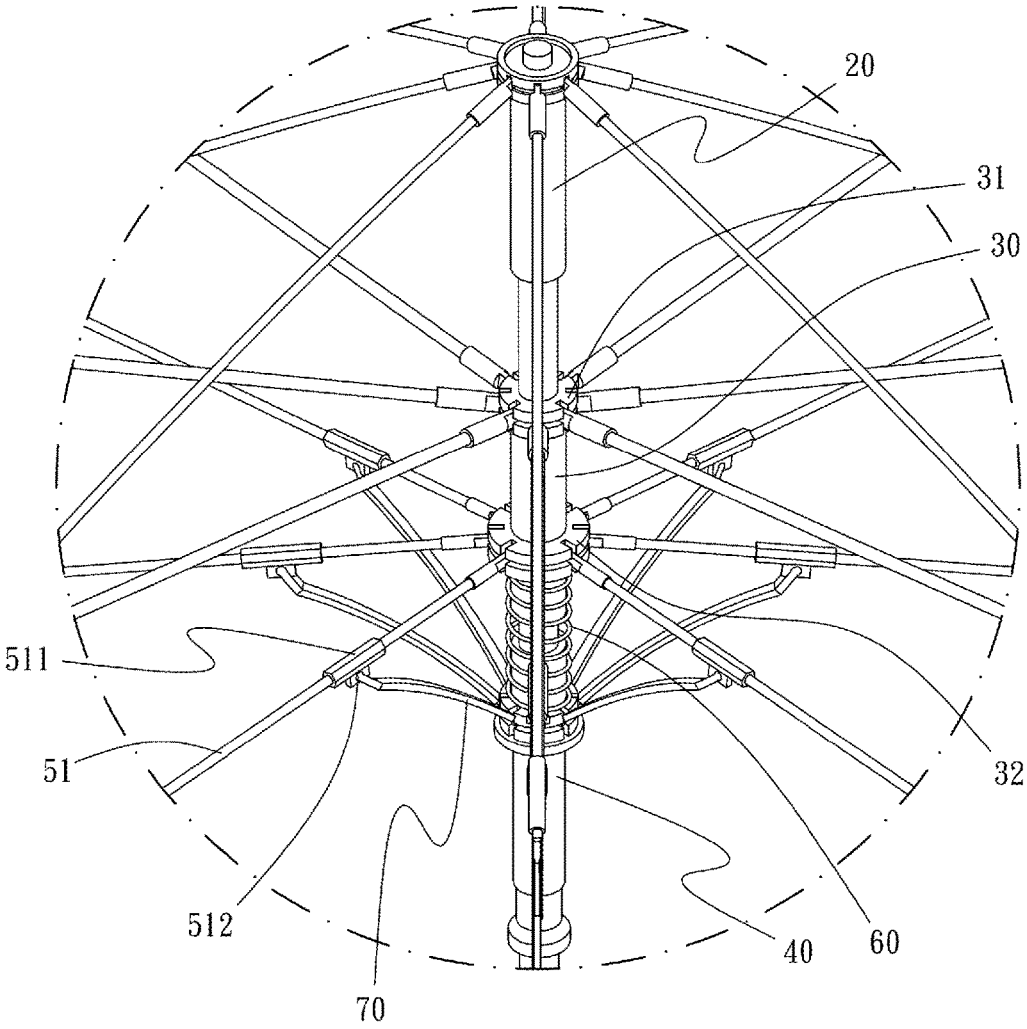
FIG. 3 is a partially enlarged view of the skeleton structure.
Figure 4:
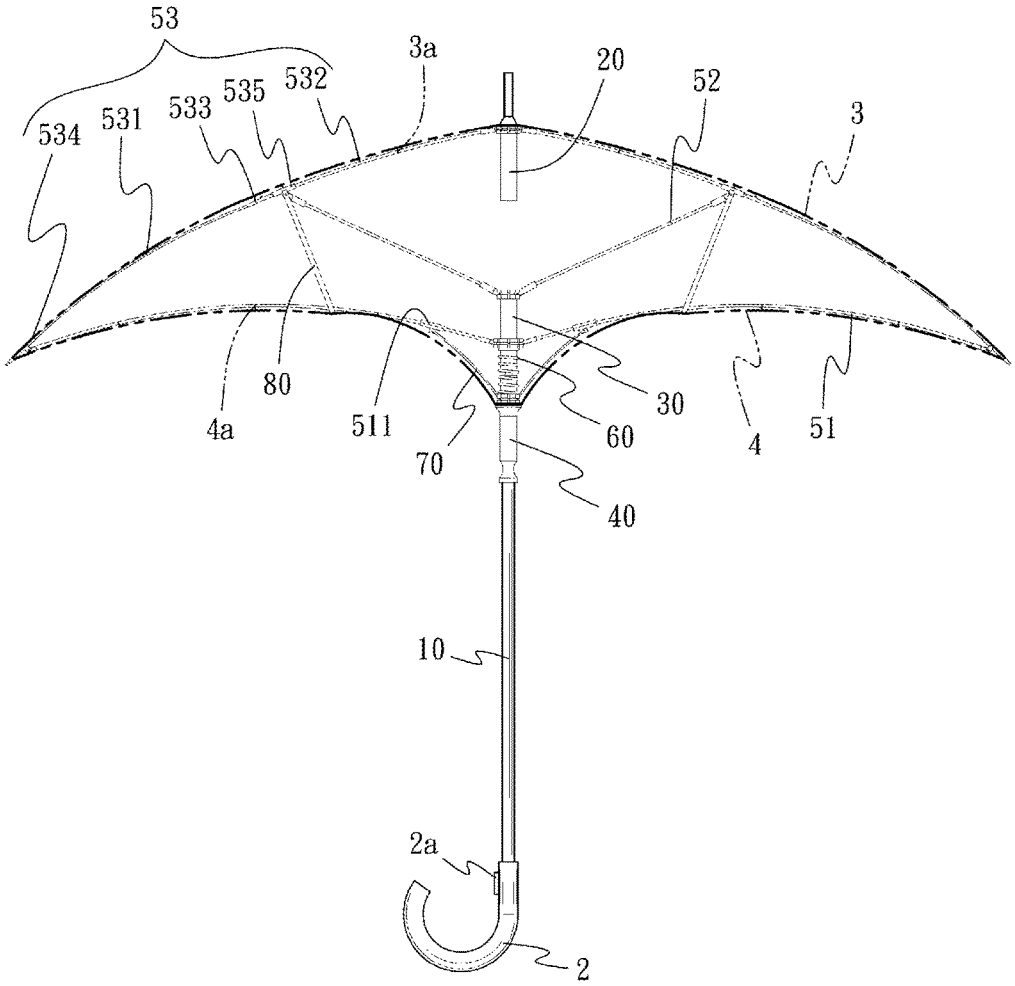
FIG. 4 is a side view of the automatic inversely foldable umbrella in an expanded status.

Referring to FIG. 3 and FIG. 4, the skeleton structure 1 comprises a main shaft 10, an upper runner 20, a middle runner 30, a lower runner 40, plural skeleton linkages 50, a resilient member 60, and plural linking members 70. The first canopy 3 is disposed on the upper runner 20 by the central portion of the first canopy 3, and the second canopy 4 is disposed on the lower runner 40 by the central portion of the second canopy 4, such that the skeleton linkages 50 are covered in the first canopy 3 and the second canopy 4.

The main shaft 10 is provided with two ends. The upper runner 20 is formed in a barrel shape and mounted around one end of the main shaft 10. The lower runner 40 is formed in a barrel shape and slidably mounted on the main shaft 10. The middle runner 30 is formed in a barrel shape and slidably mounted around the main shaft 10 between the upper runner 20 and the lower runner 40. The middle runner 30 is provided with a first connecting end 31 facing the upper runner 20 and a second connecting end 32 facing the lower runner 40.

The resilient member 60 is a compressible spring mounted around the main shaft 10 and disposed between the middle runner 30 and the lower runner 40. Also, one end of the resilient member 60 is connected with the middle runner 30, with the other end of the resilient member 60 connected with the lower runner 40, such that the resilient member 60 is able to be compressed due to a movement of the middle runner 30 and the lower runner 40.

Each of the skeleton linkage 50 comprises a first rib 51, a second rib 52, and a foldable rib 53. The first rib 51 is provided with a pivoting end, a free end, and a positioning portion 511, wherein the free end is an end of the first rib away from the middle runner, and the pivoting end and the free end of the first rib 51 are disposed on two opposite ends of the first rib 51, respectively. The pivoting end of the first rib 51 is pivotally disposed on the second connecting end 32 of the middle runner 30. The positioning portion 511 of the first rib 51 is fixed between the pivoting end and the free end. Also, the positioning portion 511 of the first rib 51 is provided with a positioning notch 512.

The foldable rib 53 has one end thereof pivotally disposed on the upper runner 20, with the other end thereof pivotally connected with the free end of the first rib 51. In an embodiment of the present invention, the foldable rib 53 comprises a first foldable rod 531, a second foldable rod 532, and a folding portion 533 disposed between the first foldable rod 531 and the second foldable rod 532, such that the first foldable rod 531 is allowed to be folded against the second foldable rod 532 toward the upper runner 20. Further, the foldable rib 53 includes a first disposition portion 534 and a second disposition portion 535. The first disposition portion 534 is disposed on the first foldable rod 531 and arranged in adjacent to the joint where the first canopy 3 contacts the second canopy 4. The second disposition portion 535 is disposed on the second foldable rod 532 and arranged between the first disposition portion 534 and the upper runner 20. The first disposition portion 534 is pivotally connected by the first rib 51. The folding portion 533 is positioned between the first disposition portion 534 and the second disposition portion 535; the distance between the second disposition portion 535 and the folding portion 533 is smaller than the distance between the first disposition portion 534 and the folding portion 533.

The second rib 52 has one end thereof pivotally disposed on the first connecting end 31 of the middle runner 30, with the other end thereof pivotally disposed on the second disposition portion 535 of the foldable rib 53.

The linking member 70 is flexible. The length of the linking member 70 is smaller than the second rib 52, and the length of the second rib 52 is smaller than the first rib 51. One end of the linking member 70 is pivotally disposed on the lower runner 40, and the other end of the linking member 70 is formed in a rod shape and tightly engaged with the positioning notch 512 of the first rib 51, whereby an easy assembling and maintaining function are achieved. When the skeleton structure 1 is being folded, the combination of the linking member 70 and the first rib 51 pulls to maintain the position of the middle runner 30, such that the middle runner 30 is prevented from being pushed away by the resilient force of the resilient member 60.

The first canopy 3 is provided with plural combining portions 3*a*, and the second canopy 4 is provided with plural combining portions 4*a*. The combining portions 3*a* of the first canopy 3 are tied on each corresponding foldable rib 53; the combining portions 4*a* of the second canopy 4 are tied on each corresponding first rib 51. Also, the first canopy 3 is peripherally provided with plural rib tips for receiving the distal end of the first foldable rib 531 of the foldable rib 53.

The handle 2 is formed in an arc shape and combined to the main shaft 10 and disposed away from the upper runner 20. The handle 2 is provided with a control structure for optionally engaging the lower runner 40. The control structure is housed inside the handle 2 and provided with a control button 2*a* which is operated by a resilient force, such that the control button 2*a* is pressed for engaging and disengaging the lower runner 40.

In an embodiment of the present invention, plural pulling members 80 are further included and disposed between the foldable rib 53 and the first rib 51. One end of the pulling member 80 and the second rib 52 are pivotally disposed on the second disposition portion 535, with the other end of the pulling member 80 winding the first rib 51. The length of the pulling member 80 is larger than the length of the linking member 70. By use of the pulling member 80, the skeleton linkage 50 forms a stable linkage structure during the folding and expanding process, whereby the first canopy 3 and the second canopy 4 are allowed to be folded or expanded.

Referring to FIG. 4 illustrating the expanded status of an embodiment of the present invention, the resilient member 60 is performed in an expanding status, such that the skeleton linkage 50 is expanded. As shown in the drawing, the first rib 51, the linking member 70, and the foldable rib 53 are performed in a bent shape due to the expansion. Therefore, the skeleton linkage 50 is prevented from easily deforming due to a rapid or sudden raining falling upon the first canopy 3.

Figure 5:
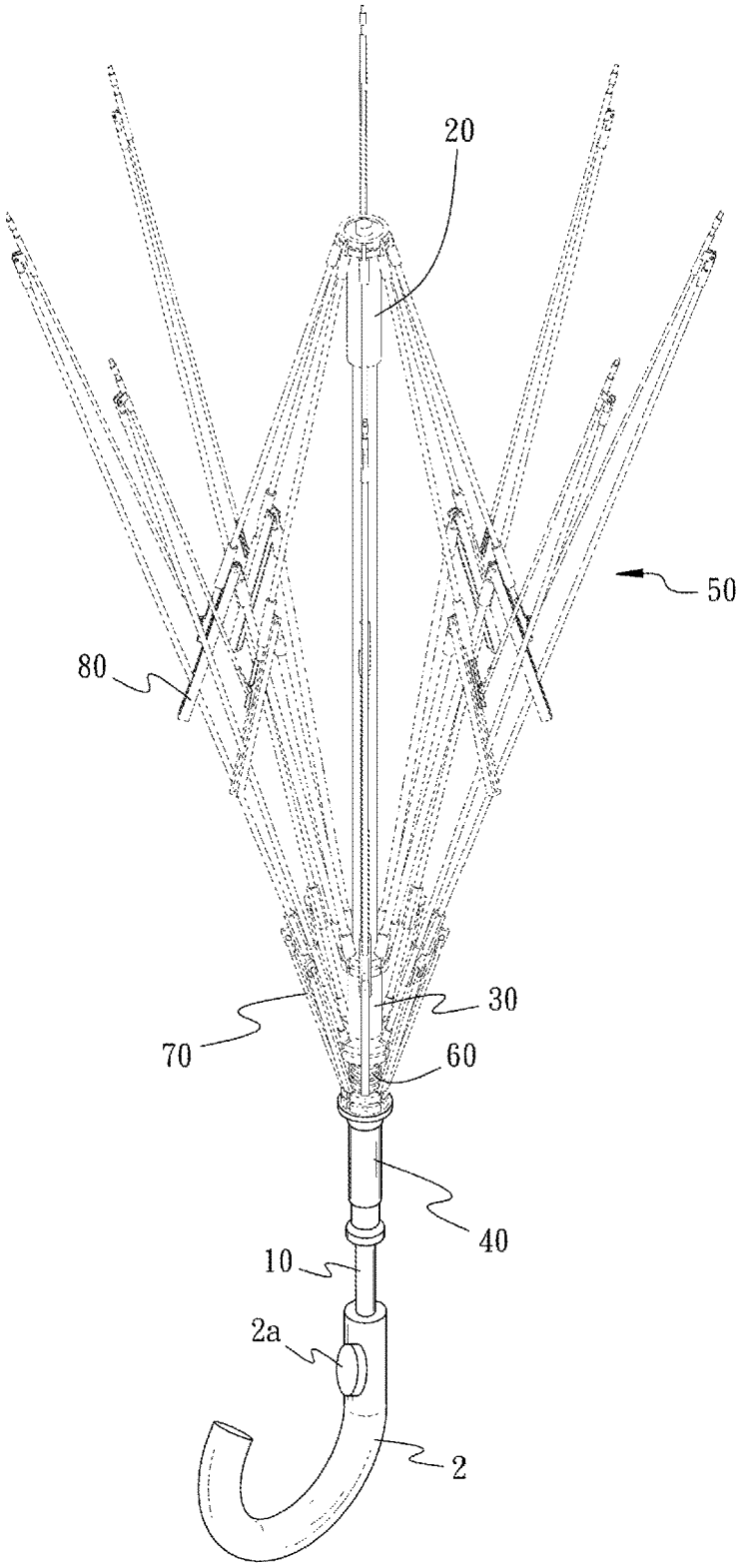
FIG. 5 is a perspective view of the skeleton structure in a folded status
Figure 6:
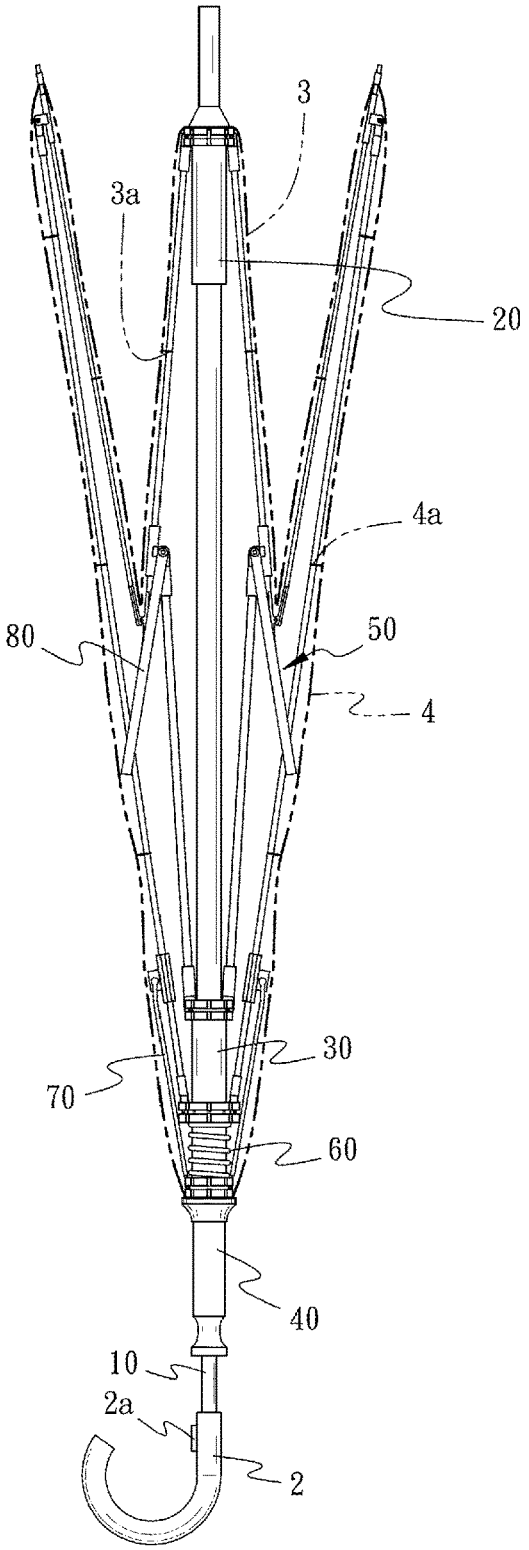
FIG. 6 is a side view of the skeleton structure in the folded status.

Referring to FIG. 5 and FIG. 6, when the umbrella is being folded, the lower runner 40 is pulled toward the handle 2 for triggering the linking members 70 to pull the first ribs 51, such that the first ribs 51 and the second ribs 52 are folded toward the upper runner 20. During the folding operation, the resilient member 60 is gradually compressed, while the pulling members 80 provide a pulling function for folding the foldable ribs 53. In other words, the pulling members 80 drive the second foldable rod 532 to carry out the folding function, whereby the first foldable rod 531 is folded against the second foldable rod 532 toward the upper runner 20, facilitating the folding process of the skeleton linkage 50. Finally, referring to the folded position shown by FIG. 6, the control structure of the handle 2 is applied for engaging the lower runner 40, completing the folding process of the first canopy 3 and the second canopy 4.

On the other hand, when the umbrella is to be expanded, the user needs only to operate the control button 2*a* for disengaging the lower runner 40, such that the lower runner 40 is detached from the handle 2. The resilient member 60 subsequently returns to the normal length, such that the skeleton linkage 50 of the present invention is automatically expanded. With such configuration and operation method, the umbrella of the present invention is operated to be stably expanded or folded.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An automatic inversely foldable umbrella, comprising:

a skeleton structure, wherein the skeleton structure further comprises:

a main shaft;

an upper runner fixed to one end of the main shaft;

a lower runner slidably disposed on the main shaft;

a middle runner slidably disposed on the main shaft between the upper runner and the lower runner, the middle runner including a first connecting end facing the upper runner and a second connecting end facing the lower runner;

plural skeleton linkages, each skeleton linkage including a first rib, a second rib, and a foldable rib, one end of the first rib pivotally disposed on the second connecting end of the middle runner, one end of the foldable rib pivotally disposed on the upper runner with the other end of the foldable rib pivotally connected to an end of the first rib away from the middle runner, one end of the second rib pivotally disposed on the first connecting end of the middle runner with the other end of the second rib pivotally disposed on the foldable rib;

plural linking members, one end of each linking member pivotally disposed on the lower runner with the other end of the linking member connected with the corresponding first rib;

a resilient member disposed between the middle runner and the lower runner, the resilient member compressed due to a movement of the middle runner and the lower runner;

a first canopy combined to the upper runner;

a second canopy combined to the lower runner, the first canopy and the second canopy covering the skeleton linkages; and a handle combined to the main shaft and disposed away from the upper runner, the handle including a control structure optionally engaging the lower runner, each foldable rib provided with a first disposition portion and a second disposition portion, the first disposition portion disposed adjacent to a joint where the first canopy contacts the second canopy, the second disposition portion disposed between the first disposition portion and the upper runner, the first disposition portion pivotally connected to the corresponding first rib, the second disposition portion pivotally connected to the corresponding second rib;

a plurality of pulling members, each pulling member disposed between the foldable rib and the corresponding first rib of each skeleton linkage, respectively, with one end of the pulling member and the corresponding second rib disposed on the corresponding second disposition portion, and another end of the pulling member winding around the first rib.

2. The umbrella of claim 1, wherein the linking members are flexible.

3. The umbrella of claim 1, wherein the linking members are covered by the second canopy; a length of the linking member is smaller than a length of the second rib; the length of the second rib is smaller than a length of the first rib.

4. The umbrella of claim 3, wherein the first rib is provided with a positioning portion, the positioning portion includes an open positioning notch for engaging the corresponding linking member.

5. The umbrella of claim 1, wherein the second canopy is provided with plural combining portions, the combining portions of the second canopy being tied on the corresponding first rib, respectively.

6. The umbrella of claim 5, wherein the first canopy is provided with plural combining portions, the combining portions of the first canopy being tied on the corresponding foldable rib, respectively.

7. The umbrella of claim 1, wherein the resilient member is a compressible spring.

8. The umbrella of claim 1, wherein the control structure is housed inside the handle and comprises a control button which is operated by a resilient force.

9. The umbrella of claim 1, wherein a length of the pulling member is larger than a length of the linking member.

10. The umbrella of claim 1, wherein the foldable rib comprises a first foldable rod, a second foldable rod, and a folding portion disposed between the first foldable rod and the second foldable rod, such that the first foldable rod is allowed to be folded against the second foldable rod toward the upper runner.

11. The umbrella of claim 10, wherein the folding portion is disposed between the first disposition portion and the second disposition portion; a distance between the second disposition portion and the folding portion is smaller than a distance between the first disposition portion and the folding portion.

12. The umbrella of claim 1, wherein when the control structure engages the lower runner, the skeleton linkage is in a folded status; when the control structure disengages the lower runner, the skeleton linkage is in an expanded status, wherein the first rib, the linking member, and the foldable rib are in a bent shape.

* * * * *